US005515802A

United States Patent [19]

Bree

[11] Patent Number: 5,515,802

[45] Date of Patent: May 14, 1996

[54] BUOYANCY DEVICE

[76] Inventor: Charles C. Bree, 5 Bancroft Crescent, Glendene, Auckland, New Zealand

[21] Appl. No.: 331,584

[22] PCT Filed: May 3, 1993

[86] PCT No.: PCT/NZ93/00033

§ 371 Date: Nov. 4, 1994

§ 102(e) Date: Nov. 4, 1994

[87] PCT Pub. No.: WO93/22191

PCT Pub. Date: Nov. 11, 1993

[30] Foreign Application Priority Data

May 5, 1992 [NZ] New Zealand ..... 242618

[51] Int. Cl.[6] ..... B63B 43/14

[52] U.S. Cl. ..... 114/123; 114/219

[58] Field of Search ..... 114/68, 218, 219, 114/123

[56] References Cited

U.S. PATENT DOCUMENTS 3,026,548 3/1962 Dollinger ..... 114/219

3,498,252 3/1970 Peacock ..... 114/219

FOREIGN PATENT DOCUMENTS 1355545 11/1987 U.S.S.R. ..... 114/219

*Primary Examiner*—Jesus D. Sotelo

*Attorney, Agent, or Firm*—Young & Thompson

[57] ABSTRACT

A buoyancy device (10) comprises an inflatable shell (12) of resiliently deformable moulded plastics material. The shell (12) has a tubular wall (14) having zones (20) in which the wall (14) is indented so that it is capable of easy deformation in the axial direction relative to cylindrical portions (22) of the wall (14) adjacent each side of the zones (20). At each indentation, the wall (14) comprises two substantially cresent-shaped portions which project inwardly from the cylindrical portions (22). The shell (12) has integrally moulded lugs (18) for assisting mounting of the device (10) on the curved side of a boat. The cresent-shaped portions of the wall (14) and the lugs (18) are located on opposite sides of the shell (12).

8 Claims, 3 Drawing Sheets

BUOYANCY DEVICE

FIELD OF THE INVENTION

This invention relates to a buoyancy device which is particularly but not necessarily exclusively suited to mounting on small craft such as row boats or dinghies for adding buoyancy and thus render them less likely to overturn or sink in the event of an accident.

DISCUSSION OF PRIOR ART

Many proposals have been put forward to provide reserve buoyancy for small craft. For example, it is common to construct the seats of rigid row boats and small power driven boats as water tight compartments. Non-rigid inflatable boats are also common. These are constructed of flexible material incorporating one or more watertight compartments into which air can be pumped through suitable valves. When inflated, the compartments become rigid enough to hold the boat in its designed shape and provide the necessary buoyancy to enable the boat to float. Boats have also been designed comprising rigid hulls to which tubes of flexible material are attached. The tubes can be inflated to provide buoyancy. An example of this latter construction is disclosed in international patent application #PCT/AU91/00207, now abandoned.

It would in principle be possible to attach one or more inflatable devices such as conventional fenders (or "bumpers" as they are called in the USA) to a boat so as to increase the buoyancy thereof. It would be logical to position such devices around the hull of the boat so as to spread the buoyancy evenly and ensure maximum stability. It would be natural to use tubular fenders for this purpose. It has however been found by the applicant that a conventional tubular fender or similar straight tubular device is not well suited to this purpose since the wall thereof has a tendency to kink when the device is pulled against the curved side of the hull in the process of being mounted. (Analogously, the tubes mounted on the boats disclosed in the above-mentioned international application #PCT/AU91/00207 are moulded to conform to the shaped of the hull to avoid kinking). On the other hand it is not economically feasible to provide a variety of tubular devices with different curvatures so that individual ones can be selected to fit particular hull shapes.

It is an object of the invention to provide a buoyancy device which can more readily take up a curved shape without kinking.

SUMMARY OF THE INVENTION

According to the invention there is provided a buoyancy device comprising an inflatable shell having a resiliently deformable tubular wall including at least one zone located between two substantially cylindrical portions of said wall, in which zone the wall comprises segments which project inwardly from the periphery of said substantially cylindrical portions, characterised in that each segment is disposed about at least a part of the periphery of the shell and comprises a pan of maximum width on each side of which part the width of said segment diminishes progressively with increasing distance from the pan of maximum width.

In one aspect of the invention said substantially cylindrical portions are right circular cylindrical.

In another aspect of the invention each said segment comprises sub-segments each of which has the shape of pan of an annulus. In an alternative aspect of the invention each said segment is substantially crescent shaped.

According to a particular aspect of the invention said segments adjoin the respective substantially cylindrical portions adjacent their outer peripheries and are joined to each other adjacent their inner peripheries.

In one form of the invention the shell is provided with means for assisting mounting of the device on a support.

According to one aspect of the invention said pans of maximum width of said segments and said means for assisting mounting of the device on a support are located on opposite sides of the shell.

According to a particular aspect of the invention the means for assisting mounting of the device on a support comprise formations which are moulded integrally with the shell. Advantageously the formations comprise lugs provided with apertures for receiving fasteners whereby the device can be mounted on a support.

In one form of the invention the shell is a substantially one-piece air-tight moulding of flexible plastics material.

In one form of the invention the shell is provided with a valve by means of which it can be inflated.

BRIEF DESCRIPTION OF THE DRAWINGS

An embodiment of the invention is discussed by way of example with reference to the accompanying drawings in which.

DETAILED DESCRIPTION OF EXAMPLES SHOWN IN THE DRAWINGS

Figure 1:
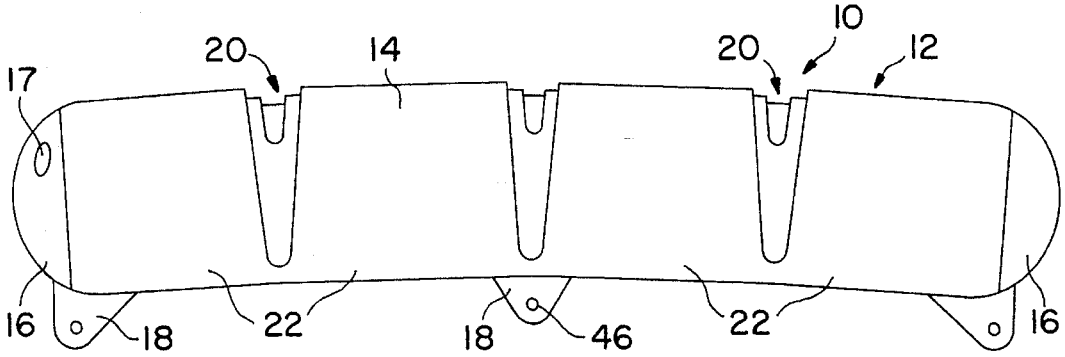
FIG. 1 is a plan view of an inflatable device which can be used as a fender or as a buoyancy aid for attachment to a small boat, the device being shown in the shape which it assumes when it is inflated but before it is attached to the boat.
Figure 2:
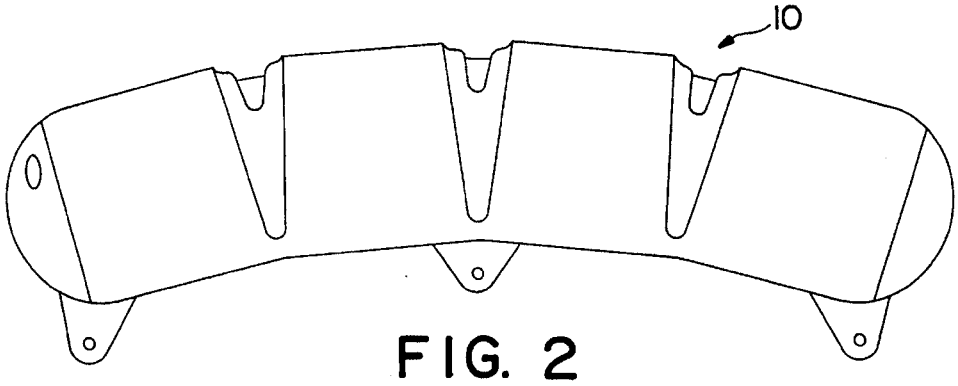
FIG. 2 is a plan view of the device shown in FIG. 1, shown in a shape which it takes up when it is mounted on a curved surface such as the side of a small boat.
Figure 3:
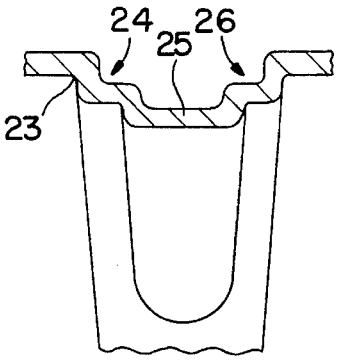
FIG. 3 is an enlarged cross sectional detail of pan of the device when it is in its natural shape before beng inflated.
Figure 4:
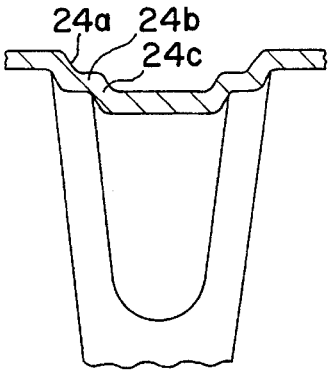
FIG. 4 is a similar view of the same part of the device when it is has taken up the shape shown in FIG. 2.

In the drawings there is shown a device 10 comprising a shell 12 which, in the present example, is a one-piece moulding of a resiliently deformable, synthetic plastics material, in this case being polyvinyl chloride (PVC). Other materials may be suitable such as EVA or the materials commonly used to make inflatable boat fenders. The shell is conveniently formed by a conventional rotation moulding process.

The shell comprises an elongate tubular wall 14 closed by integrally moulded, dome shaped ends 16. In the present example, the wall is for the most part conceptually right-circular cylindrical in but, as will be well understood by those skilled in the art, will tend to be distorted out of this shape when it is inflated. The wall could also have other shapes. It could, for example be of square, rectangular or oval cross section.

A conventional valve 17 is mounted in one of the ends of the shell. The valve enables the shell to be inflated or deflated.

Figure 5:
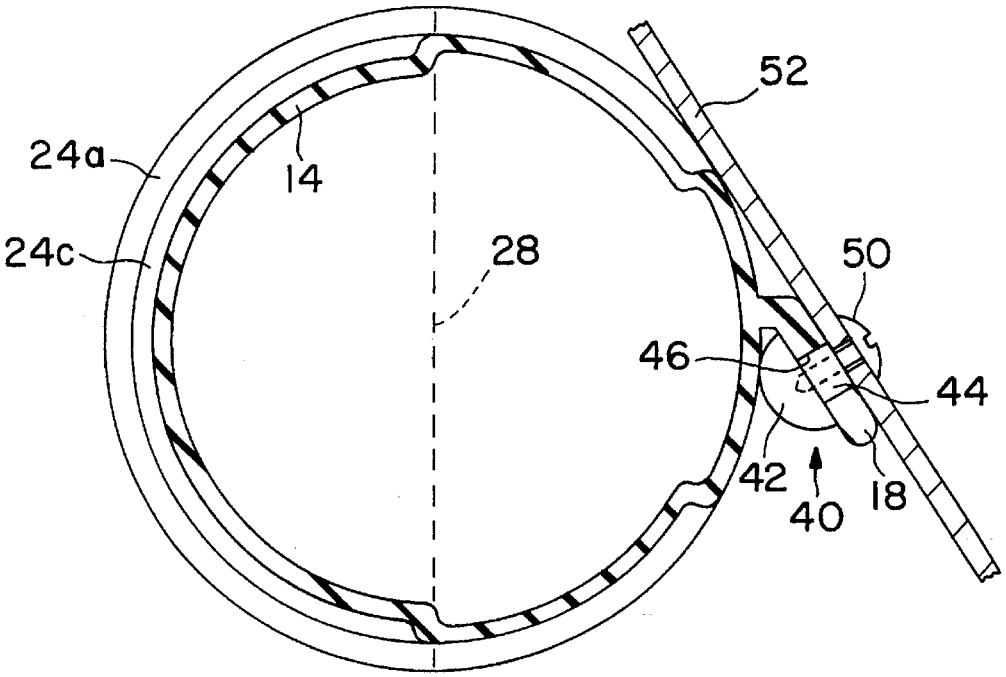
FIG. 5 is a cross-sectional view on Arrows A—A in FIG. 6.
Figure 6:
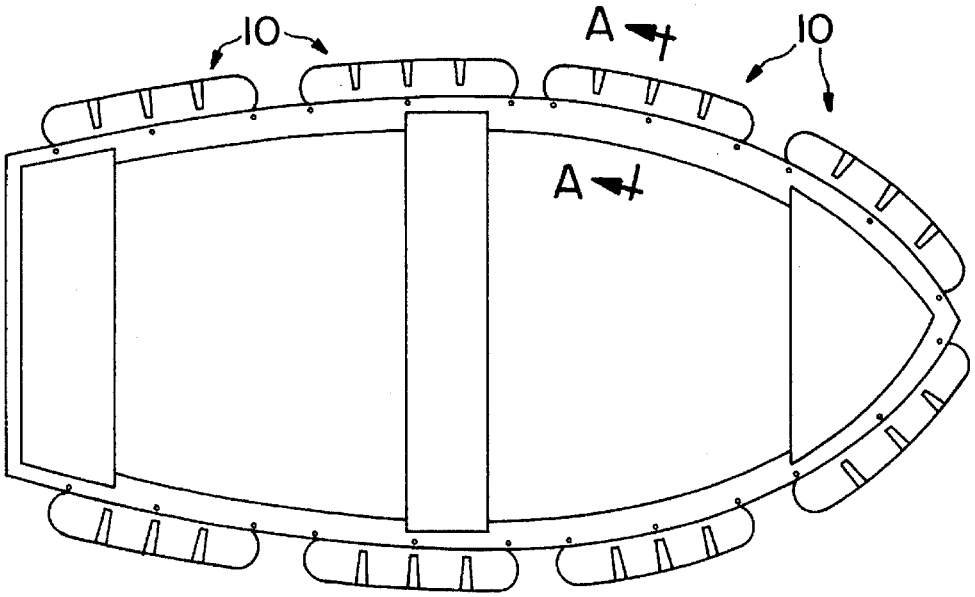
FIG. 6 is a plan view of a small boat on which are mounted eight devices of the type shown in the drawings.

The devices are constructed so that a number of them can be mounted on the sides of a rigid boat as shown in FIGS. 5 and 6. For this purpose three evenly spaced lugs 18 are provided in the wall. These lugs are located along a line close to where the shell makes contact with the boat. It is thus convenient to consider the lugs as being located on the 'inner' side of the shell.

In the shell there are three zones 20 where the wall is indented. These zones are discussed in detail below but their centroids are located along a line which is diametrically opposite the aforementioned line on which the lugs 18 are located. It is thus convenient to consider the zones as being located on the 'outer' side of the shell. The zones are approximately evenly spaced from each other and from the ends of the shell so that adjacent both sides of each zone there are right circular cylindrical portions 22 of the wall which are of equal length. In the present example, at each indentation, the wall comprises two portions or segments 24, 26 which, viewed in the axial direction, are substantially crescent-shaped. At their outer edges, the respective segments adjoin the adjacent cylindrical portions 22. At their inner edges the segments are joined to each other by a bridging portion 25. The segments are disposed at an angle to, and project inwardly from the periphery of, the cylindrical portions 22.

In their simplest form the segments 24, 26 could be substantially fiat. However, as illustrated, they have a stepped cross sectional configuration. For example the segment 24 comprises a pair of sub-segments 24*a*, 24*c* joined by an intermediate portion 24*b*.

The segment 26 is similarly configured. This configuration is more suited to the rotation moulding process besides making the segments more flexible.

Figure 7:
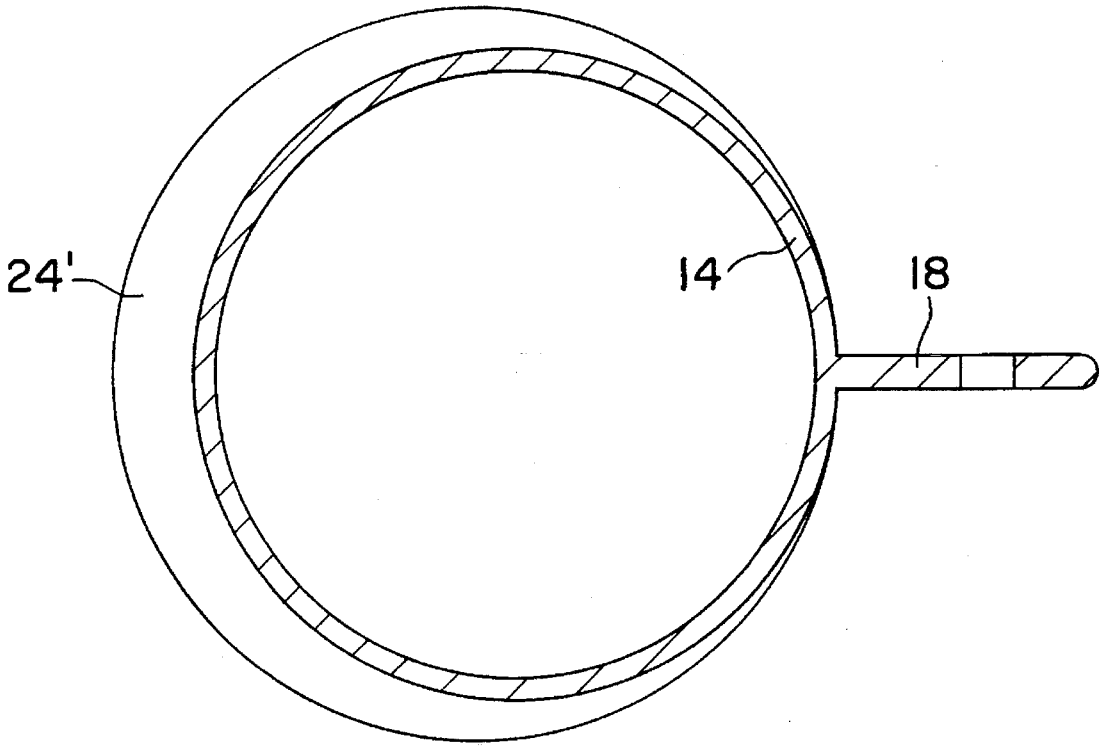
FIG. 7 is a view, similar to FIG. 5, of a modified device.

In the device illustrated in FIGS. 1 to 6, each segment 24, 26 has the shape of a portion of an annulus. FIG. 7 shows a segment 24' which is substantially flat and crescent shaped. It should be clear to the skilled addressee that both of these segment shapes could be modified.

Also, broadly speaking, the segments need not be crescent shaped or have the shape of a portion of an annulus. For example, they could be flat and sector-shaped in which case their inner edges might be indicated by the dotted line 28 in FIG. 5. The shape of the segments would also be influenced by the cross sectional shape of the shell.

When the shell 10 is deflated, the segments (or subsegments) are more nearly parallel to each other and perpendicular to the longitudinal axis of the shell than when the shell is inflated and, in particular, when the device 10 is pulled up against the curved side of a boat as shown in FIG. 6. The shell is then distorted so that the outer side of the wall comes under tension. The indentations in the wall then act in bellows fashion, the segments 24, 26 being able to move apart readily from each other in the axial direction due to their disposition. This allows the outer side of the shell to elongate easily and prevents the inner side from collapsing and forming kinks under the pressure of the side of the boat.

As a matter of fact the aforementioned construction of the shell causes the outer side to elongate to some extent under inflation pressure alone so that the shell takes up the slightly curved shape shown in FIG. 1 even before it is pulled up against the side of the boat.

In the drawings the depth of the indentations has been exaggerated to some extent for the sake of illustration. In practice the depth is such that when the device 10 has been pulled into a curved shape against the side of a boat the parts of the wall forming the indentations are nearly flush with the parts of the wall on either side of the indentations.

The indentations could extend right around the shell in which case the segments would be of annular shape.

It is an advantage of the invention that the devices 10 may be applied to small boats which have already been built or sold and which have inadequate reserve buoyancy. It would usually be appropriate to mount the devices along a line just below the gunwhale. The devices are conveniently attached to the boat by means of screws or similar fasteners. A suitable fastener is shown at 40 in FIG. 5. It has a domed head 42 of large diameter and a shank 44 which is a close fit in an aperture 46 moulded in a lug 18. A self-tapping screw 50 is passed through a hole drilled in the side 52 of the boat and screwed into a hole moulded in the end of the shank. The lug is pulled up flat against the boat side in the process. The device hangs downwardly from the lugs and bears against the domed heads 42 which to some extent lift the device up and away from the boat side. In practice the weight of the shell would cause the wall 14 to be pressed inwardly where it bears on the domed head 42.

In a further modification both the indentations and the lugs are located on the inner side of the device. Thus, when the device is pulled up against the side of the boat, the shell contracts on its inner side. The contraction takes place largely at the indentations, the segments moving towards each other. Their ability to do so helps to prevent the shell from kinking.

When the devices are to be mounted on a boat for the first time it is easiest if they are in the deflated condition. In practice they would usually be mounted on the boat permanently. However, it has been found that they tend to take up a permanent curved shape when they are left on the boat for any length of time so that, if they are subsequently removed, they can if necessary be replaced without being deflated.

In one example, the devices 10 are about 60 cm long and about 12 cm in diameter with a wall thickness of about 3 mm. These sizes could vary within wide limits.

It is not intended that the scope of a patent granted in pursuance of the application of which this specification forms a part should exclude modifications and/or improvements to the embodiments described and/or illustrated which are within the scope of the invention as defined the claims or be limited by details of such embodiments further than is necessary to distinguish the invention from the prior art.

I claim:

1. A buoyancy device comprising an inflatable shell having a resiliently deformable tubular wall including at least one zone located between two substantially cylindrical portions of said wall, in which zone the wall comprises segments which project inwardly from the periphery of said substantially cylindrical portions, each segment being disposed about at least a part of the periphery of the shell and being substantially crescent shaped so that it comprises a part of maximum width on each side of which part the width of said segment diminishes progressively with increasing distance from the part of maximum width.

2. A buoyancy device according to claim 1, wherein said substantially cylindrical portions are right circular cylindrical.

3. A buoyancy device according to claim 1, wherein said segments adjoin the respective substantially cylindrical portions adjacent their outer peripheries and are joined to each other adjacent their inner peripheries.

4. A buoyancy device according to claim 1, wherein the shell is provided with means for assisting mounting of the device on a support.

5. A buoyancy device according to claim 4, wherein said parts of maximum width of said segments and said means for assisting mounting of the device on a support are located on opposite sides of the shell.

6. A buoyancy device according to claim 5, wherein said means for assisting mounting of the device on a support comprise formations which are moulded integrally with the shell.

7. A buoyancy device according to claim 6, wherein the formations comprise lugs provided with apertures for receiving fasteners whereby the device can be mounted on a support.

8. A buoyancy device according to claim 1, wherein the shell is a substantially one-piece air-tight moulding of flexible plastics material.

* * * * *